US008006529B2

(12) United States Patent
DeFranks et al.

(10) Patent No.: US 8,006,529 B2
(45) Date of Patent: Aug. 30, 2011

(54) METHODS FOR MANUFACTURING COIL SPRINGS

(75) Inventors: Michael DeFranks, Atlanta, GA (US); Michael DiMarco, Atlanta, GA (US); Larry Banks, Atlanta, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 1050 days.

(21) Appl. No.: 10/661,363

(22) Filed: Sep. 12, 2003

(65) Prior Publication Data

US 2005/0056066 A1 Mar. 17, 2005

(51) Int. Cl.
*B21F 3/02* (2006.01)
*B21D 3/12* (2006.01)

(52) U.S. Cl. ..... 72/135; 72/183

(58) Field of Classification Search ..... 72/66, 133, 72/135, 138, 183, 8.6, 10.2, 12.6, 19.2, 17.3, 72/79, 142–144; 226/21, 137; 242/418.1, 242/418, 420, 564, 592, 598, 598.3, 598.4, 242/598.5, 599.3; 140/103; 29/33 F; 57/59–62
See application file for complete search history.

(56) References Cited

U.S. PATENT DOCUMENTS 3,478,408 A * 11/1969 Brown ..... 72/142
3,993,257 A 11/1976 Pietroni
4,523,447 A * 6/1985 Sticht et al. ..... 72/144
4,625,503 A * 12/1986 Dubots et al. ..... 57/59
4,889,327 A 12/1989 Seyler
5,105,642 A 4/1992 Mohr
5,240,194 A * 8/1993 Noirot et al. ..... 242/418.1
5,243,746 A * 9/1993 Shinichi ..... 140/71.5
5,392,977 A * 2/1995 Kato ..... 226/42
5,477,715 A * 12/1995 Kempf ..... 72/12.1

(Continued)

FOREIGN PATENT DOCUMENTS

DE 815907 10/1951

(Continued)

*Primary Examiner* — Teresa M Ekiert
(74) *Attorney, Agent, or Firm* — Cantor Colburn LLP

(57) ABSTRACT

The systems and methods include a feed mechanism supplying multi-strand wire to a coil-spring winder. The coil spring typically has a plurality of turns and is resilient. The multi-strand wire is typically steel, but may be of other suitable material, or a combination of materials. The coil-spring winder receives wire from a spool of wire and forms that wire into a coil spring. Typically, but not always, the coil-spring winder cuts the coil spring to a desired length, and thereby forms a plurality of coil springs of the type that can be employed in mattresses, furniture, car seats, for industrial machines, or for any other application. To feed the coil-spring winder, the systems include a wire holder that supplies the wire to the coil-spring winder along a feed direction. The wire holder is supported for rotation about an axis that may be aligned with the feed direction. The rotation of the wire holder may be substantially synchronous with the formation of the turns of the coil spring. In one embodiment, the spool of wire is mounted onto a wire holder rotatable about a holding axis for reducing torque about a cross section of the wire. Thus, as the spool of wire revolves around the central spool axis, the spool also revolves around a second axis, which typically is orthogonal to the spool axis. In this way, it is understood that the coil-spring winder can pull wire off the spool without it causing twisting that may unravel or snap the multi-strand wire.

26 Claims, 7 Drawing Sheets

U.S. PATENT DOCUMENTS

| | | | | |
|---|---|---|---|---|
| 5,713,115 | A | 2/1998 | Knoepfel et al. | |
| 5,865,051 | A | 2/1999 | Schorcht et al. | |
| 5,875,664 | A | 3/1999 | Scott et al. | |
| 6,470,725 | B1 | 10/2002 | Boschiero | |
| 6,588,695 | B1 * | 7/2003 | Knoch et al. ..... | 242/418.1 |

FOREIGN PATENT DOCUMENTS

| | | | |
|---|---|---|---|
| DE | 10142872 | A1 | 5/2003 |
| JP | 54061167 | | 11/1980 |
| JP | 58012357 | | 8/1984 |
| JP | 2002022781 | | 8/2003 |

* cited by examiner

METHODS FOR MANUFACTURING COIL SPRINGS

BACKGROUND OF THE INVENTION

1. Field of the Invention

The systems and methods described herein relate to coil spring manufacture.

2. Description of the Related Art

Today, mattresses are typically made of an inner spring core that is covered with a layer of padding and upholstery. The quality of the mattress depends, at least in part, on the quality of the inner spring core. The inner spring core is typically a plurality of springs each of which is made of steel and each of which has enough resiliency so that the inner spring core collectively can support a number of users that are resting comfortably on the mattress. The quality of the inner spring can vary according to a number of factors including, the design of the inner spring core, such as open coil or Marshall coil, the number of coils employed within the inner spring core, the quality of springs used in the inner spring core, and a number of other factors.

As the quality of the mattress depends in part on the quality of the springs used in the core, engineers have worked to develop improved springs that are more capable of providing support and comfort. Engineers have recently developed an inner spring core that comprises a plurality of multi-strand coils which are fashioned together to provide an inner spring core.

These new inner spring cores promise to provide more comfortable and durable mattresses. However, conventional coiler machines cannot be used to manufacture these coils. Accordingly, new systems are needed for manufacturing multi-strand coils that may be employed within the inner spring cores of mattresses.

SUMMARY OF THE INVENTION

The systems and methods described herein include systems for manufacturing coils, and techniques for manufacturing such coils.

More particularly, the systems and methods described herein include machines that feed multi-strand wire to a coil winder, to manufacture one or more coil springs. In one embodiment, these systems include a coil-spring winder that forms the wire into a coil spring. The coil spring typically has a plurality of coils, and is resilient. The wire is typically steel, but may be any other suitable material, or a combination of materials. The coil-spring winder receives wire from a wire holder, and forms the wire into a coil spring. The wire holder may include a spool or reel, about which the supply of wire is held.

Typically, but not always, the coil-spring winder cuts the coil spring to a desired length, and thereby takes wire off a spool to form a plurality of coil springs of the type that can be employed in a mattress, furniture, car seat, industrial machine, or for any other suitable application. To feed the coil-spring winder, the systems and methods described herein include a wire holder that supplies the wire to the coil-spring winder along a feed direction. The wire holder is supported for rotation about an axis that is typically aligned with the feed direction. In this case, the rotation of the wire holder may be synchronous with the formation of the coils of the coil spring.

Thus, in one embodiment, the spool of wire is mounted onto a wire holder that can rotate about an axis that is essentially aligned with the feed direction of the wire being fed into the coil-spring winder. Thus, as the spool of wire revolves around the central spool axis, the spool also revolves around a second axis, which typically is orthogonal to the spool axis. In this way, it is understood that the coil-spring winder can pull wire off the spool without it causing twisting in the wire to unravel or snap the multi-strand wire.

As described below, the systems and methods described herein include systems for manufacturing coil springs from multi-strand wire, wherein the strands may be overlaid, braided, or helically twisted along a common axis. The strands may have a cross-sectional shape that is round, elliptical, square, rectangular, flat or any other suitable shape.

In optional, alternate embodiments, the systems may have a motor for rotating the wire holder. Such alternate embodiments may also include a torque sensor for measuring torque imparted to the wire, and a motor controller responsive to the torque, for controlling the wire holder's speed or direction.

Optionally, the systems may have a magnetic-particle clutch to controllably transfer torque from a motor to the wire holder. In yet other embodiments, a magnetic-particle brake may be used to reduce the speed of, or completely stop, a rotation of the wire holder. Sensors and controllers may optionally be used to control the operation of a magnetic-particle brake or clutch.

In some embodiments, the systems may include retainers for discouraging the departure of the wire from the supply of the wire at undesirable locations, and possibly getting entangled. Such retainers are useful when the inertia of the wire holder leads to the wire holder continuing a rotational motion even after solicitation of wire from the wire holder has ceased.

Other aspects of the invention, include methods for manufacturing a coil spring from a multi-strand wire. In one practice, such methods include the steps of dispensing wire, from a wire holder, along a feed direction to a coil-spring winder, and causing the coil-spring winder to form the wire into a coil spring having a plurality of coils. The method includes rotating the wire holder about a holding axis, wherein the rotating of the wire holder prevents or reduces torque imparted to the wire. Optionally, the holding axis may be essentially aligned with the feed direction. Rotating of the wire may be substantially synchronous with the formation of coils by the coil-spring winder. The method may further include providing a motor to rotate the wire holder about the holding axis. Optionally, the method may include providing a feedback mechanism by which a motor controller controls the speed and/or direction of rotation of the motor rotating the wire holder. The feedback mechanism may measure the torque acting on the wire. Optionally, the method may provide a brake to modify the speed of rotation of the motor rotating the wire holder. The method may further include providing a clutch for regulating transferring power from the motor to the wire holder.

Other embodiments shall be apparent from the following description of certain illustrated embodiments.

BRIEF DESCRIPTION OF THE DRAWINGS

The foregoing and other objects and advantages of the invention will be appreciated more fully from the following further description thereof, with reference to the accompanying drawings, wherein.

DETAILED DESCRIPTION OF THE ILLUSTRATED EMBODIMENTS

Definitions:

For convenience, certain terms employed in the specification, including examples and appended claims, are collected here. Unless defined otherwise, all technical and scientific terms used herein have the same meaning as commonly understood by one of ordinary skill in the art to which the systems and methods described herein pertain.

The article "a" and "an" are used herein to refer to one, or to more than one (i.e., to at least one) of the grammatical object of the article, unless context clearly indicates otherwise. By way of example, "an element" means one element or more than one element.

The term "including" is used herein to mean, and is used interchangeably with, the phrase "including, but not limited to."

The term "or" is used herein to mean, and is used interchangeably with, the term "and/or," unless context clearly indicates otherwise.

The term "coil-spring winder" is used herein to mean, and is used interchangeably with, the term "spring coiler."

The term "reel" is used herein to mean, and is used interchangeably with, the term "spool." The term "reel axis" is used herein to mean, and is used interchangeably with, the term "spool axis."

The term "cross section" (or its equivalent term "cross-section") is used herein to mean a section or slice formed by a plane cutting through an object, at a non-zero angle to an axis, wherein the angle may or may not be a 90-degree angle. For example, a cross section of a wire is a section or slice formed when an imaginary or real plane cuts through the wire at a non-zero angle to the longitudinal axis of a segment of the wire neighboring the intersection of the plane and the wire.

To provide an overall understanding of the invention, certain illustrative practices and embodiments will now be described, including a machine and method for manufacturing a coil spring made of multi-strand wire. However, it will be understood by one of ordinary skill in the art that the systems and methods described herein can be adapted and modified and applied in other applications and that such other additions, modifications and uses will not depart from the scope hereof.

The systems and methods described herein provide, among other things, a coil winder capable of manufacturing coil springs from multi-strand wire. To this end, the systems include a device for releasing the rotational torque that builds on a multi-strand twisted-wire or braided cable during a coil-winding process. In one embodiment, the feeder spool assembly that provides the cable to the coiler is modified so as to allow for an additional degree of rotational freedom. This additional degree of freedom allows the wire to rotate in response to the rotational torque being applied to the multi-strand wire. This prevents or reduces damage to the wire.

Figure 1:
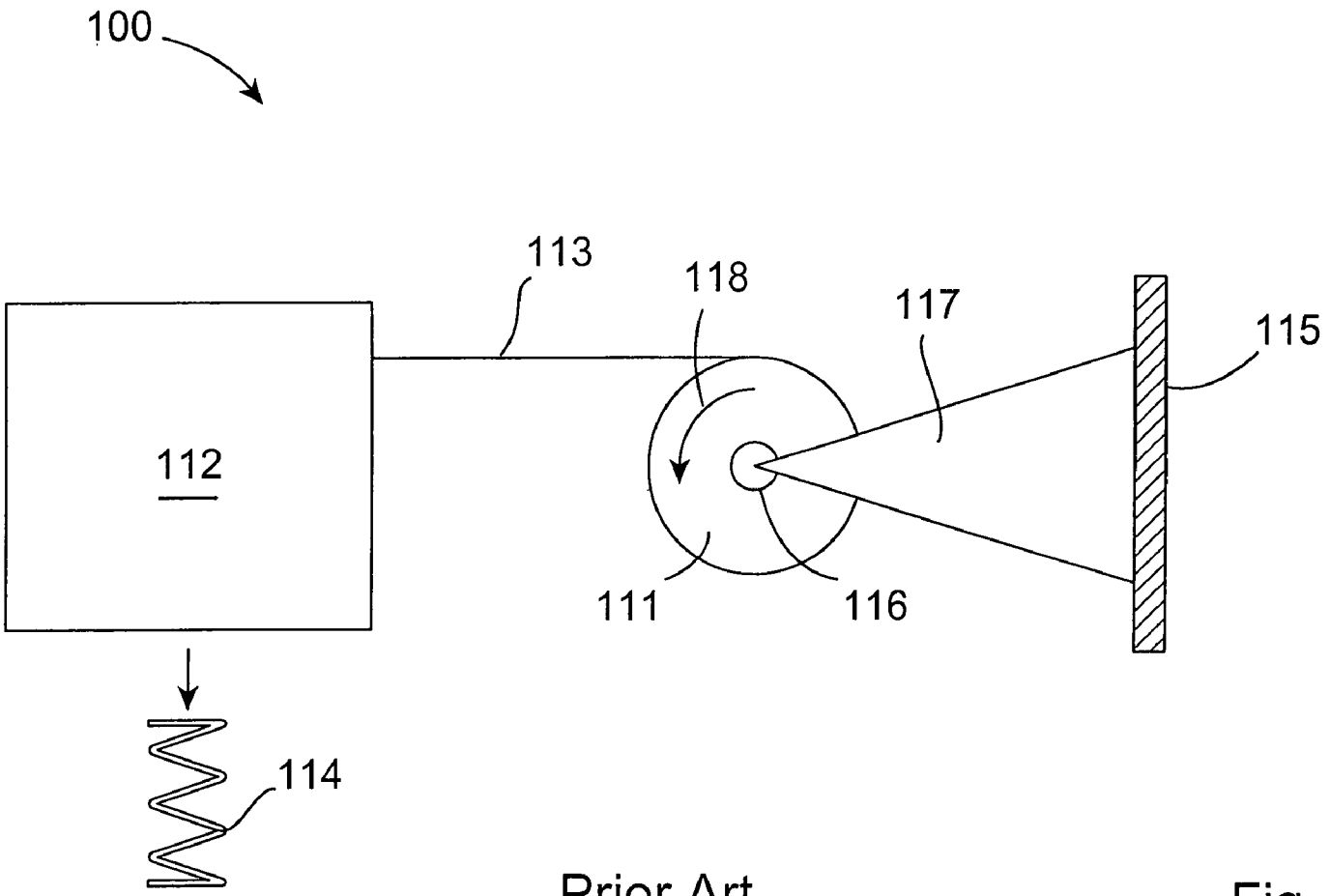
Fig. 1 Prior Art
FIG. 1 depicts a prior art system for forming coil springs from a spool of wire.

Turning to FIG. 1, there is depicted a prior-art spring coiler 100 of the type commonly employed to form coil springs from a spool of smooth single-strand steel. More specifically, FIG. 1 depicts a prior art spring coiler 100 that includes a feeding spool 111, a coil-spring winder 112, a supply of single-strand wire 113, and a fixed reference 115 that provides mechanical support for the feeding spool 111. The system 100 processes the single strand wire 113 to form the coil spring 114 depicted in the illustration. As shown, the feeding spool 111 has one degree of rotational freedom that allows the spool 111 to rotate about the depicted central spool axis 116. This single degree-of-freedom rotation is indicated with a counter-clockwise circular arrow 118. The prior art system 100 is commonly employed to form coil springs of the type used in mattresses, furniture, car seats, and industrial applications.

In the systems and methods described herein, the wire on the spool 111 is a multi-strand wire. Typically, this wire comprises a plurality of twisted or braided steel strands. In either case, the exterior surface of the multi-strand wire is knurled. Consequently, as the coil spring-winder 112 pulls the multi-strand wire off 113 the spool 111, the knurled exterior surface of the wire has a tendency to turn or torque the wire 113 as it spools into the coil-spring winder 112. This imparts a torsional torque on the wire. In time, the torque may accumulate and, depending on the direction of the torque and/or the type of multi-strand wire, cause the wire to fray or fracture.

To accommodate the torsional torque build-up in a multi-strand twisted-wire cable, the systems and methods described herein include a feeder spool 211 having a second degree of rotational freedom. Typically, this second axis of rotation 219 is substantially orthogonal, or perpendicular, to the axis 216 about which the spool 211 rotates. This is shown schematically by arrows 222 in FIG. 2.

Figure 2:
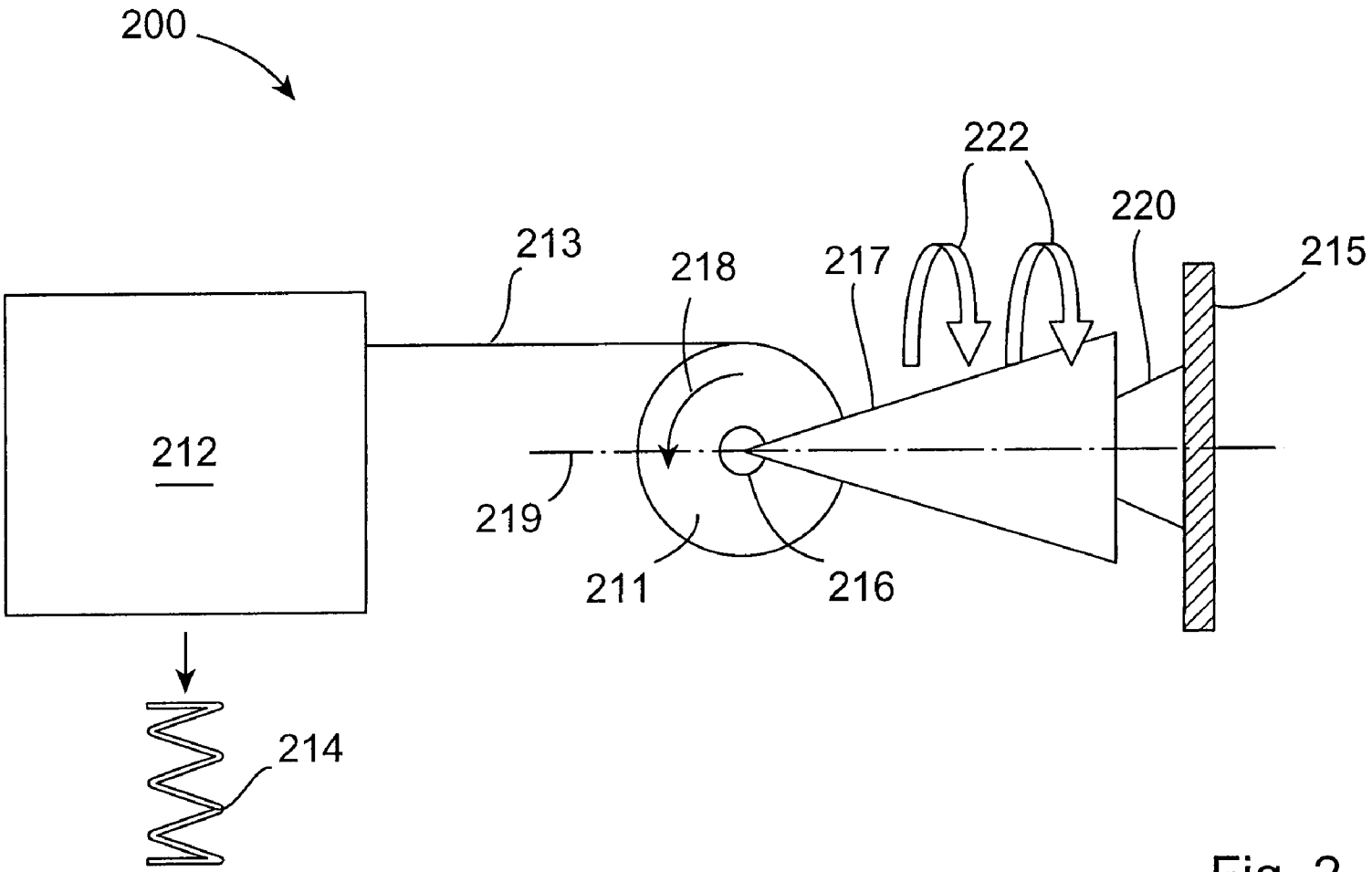
FIG. 2 depicts a first embodiment of a system, according to the invention, for forming coil springs from multi-strand wire.

As shown in FIG. 2, a feeder spool 211 is mounted to allow for rotation about the spool axis 216 as in the prior art. The mounting brace 217 of the feeder spool 211 further allows for rotation about an axis 219 substantially perpendicular to that of the spool axis 216, this secondary rotation being shown in FIG. 2 by the set of two arrows 222. This is accomplished by the addition of a coupling device 220 that responds to the torsional torque in the multi-strand wire 213 by rotating in accordance with the direction of the torsional torque, for example, around the tangential direction along which the cable 213 is released from the spool 211.

In one embodiment, the coupling device 220 includes a ball-bearing interface between the mounting brace 217 and the reference fixture 215. This is akin to the mounting apparatus of a front wheel of a supermarket cart, for example, where the wheels have two degrees of rotational freedom, one by which the cart is propelled and another which allows for the cart to turn.

Specifically, FIG. 2 depicts a first embodiment of the systems described herein wherein the spool 211 and mounting brace 217 form a wire holder that holds a spool of multi-strand wire. The wire holder is coupled to the reference fixture 215 by a coupling device 220 that allows the spool 211 and mounting brace 217 to rotate about an axis 219. Optionally, the axis 219 shown in FIG. 2 may be substantially aligned with the feed direction of the wire 213. As shown, the axis 219 is selected to allow torque acting on the wire 213 to cause the spool 211 and mounting brace 217 to rotate, thereby preventing the torque from harming the wire 213. Any axis orientation capable of allowing the spool 211 to rotate in response to the applied torque may be employed by the systems described herein to alleviate or eliminate the torsional torque accumulation in the multi-strand wire.

In one embodiment, the coupling device 220 comprises a ball bearing connector that mechanically attaches the mounting brace 217 to the reference fixture 215, and accommodates rotation about the axis 219. One such example of a ball bearing coupling device suitable for use with the system 200 is a pillow-block anti-friction bearing of the type sold by the Torrington Company, of Torrington, Conn. Other suitable bearing systems are known in the art. In operation, as wire 213 is fed into the coiler 212, a torsional torque may arise that acts on a plane orthogonal to the wire at any cross section of the wire 213, the torque being about an axis defined by the local longitudinal axis of the wire 213. As the torque increases, the force of the torque may cause the wire spool 211 and mounting brace 217 to rotate about the axis 219. As the ball bearing coupling device 220 will not support a torque, the spool 211 and mounting brace 217 will continue to rotate, possibly even substantially synchronously with the formation of coils. In this embodiment the coupling 220 serves as a passive device that allows the torque generated by the coiler 212 to cause the wire holder to rotate.

In alternate embodiments, other types of coupling mechanisms may be employed. For example, the coupling 220 may comprise an axle, bushings, a gear assembly, motors, or any other suitable device. In any case, the coupling mechanism 220 will be adapted to allow the spool 211 to rotate in a manner that prevents torsional force from building up and causing the multi-strand wire or cable 213 to fracture or to unravel.

The multi-strand wire 113 pulled from the spool 111 may be fed into a coiler, such as the coiler 112 of the prior arts system of FIG. 1. The coiler 112 can form the multi-strand wire into a coil spring that may be employed within a mattress, seat cushion, car cushion, or used in an industrial application. The systems and methods described herein are described with reference to spring coilers of the type commonly employed for making coil springs used in mattresses, including open coil mattresses, Marshall coil mattresses, and other types of mattresses. However, it will be apparent to those of ordinary skill in the art that the systems and methods described herein are not so limited, and may be employed in a plurality of other applications, including for making other types of furniture and for industrial applications in which springs have utility.

Figure 3:
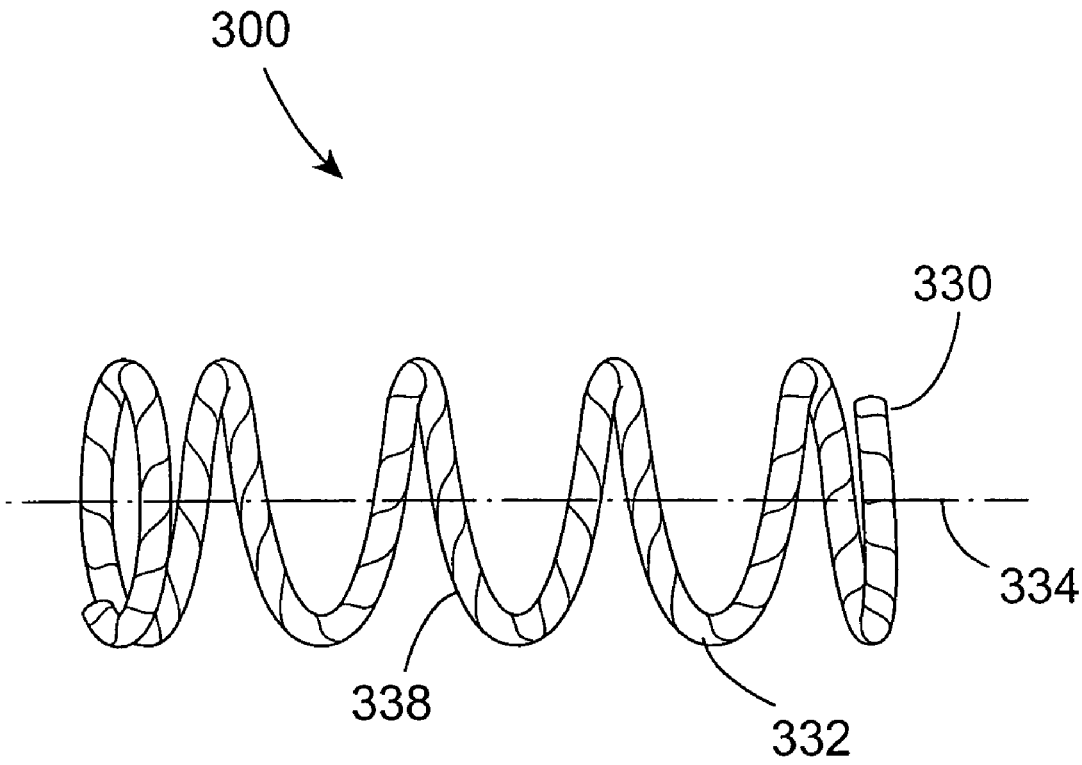
FIG. 3 depicts one embodiment of a coil spring formed from multi-strand wire.

One example of a spring made from a multi-strand wire 332 and formed into a coil by the systems and methods described herein, is depicted in FIG. 3. As can be seen from a review of FIG. 3, the multi-strand coil spring 300 is formed as a spring element formed from a piece of multi-strand wire 332 being turned into multiple loops about a central axis 334. FIG. 3 depicts the knurled surface 338 of the spring 300. The spring 300 can be used in furniture, a mattress, or a car seat. The spring 300 may be pocketed, as is sometimes done with mattress springs. The spring 300 may be used as an open-coil innerspring in a mattress. In another construction, the spring 300 may be asymmetric, or it may have non-uniform width. In yet another embodiment, the systems and methods described herein may further include a device (not shown) that braids and/or twists strands of wire to form a multi-strand wire, as the multi-strand wire is fed into the coil winder.

In the embodiment depicted in FIG. 2, the coiler includes a cutting device that is capable of cutting a coiled multi-strand wire 213 into a spring coil of the proper length. However, this cutting mechanism is optional, and in other embodiments the spring coiler 212 can provide a single coil formed from continuous loops of the multi-strand wire 213 which, in a subsequent operation can be cut down to the proper size.

Figure 4:
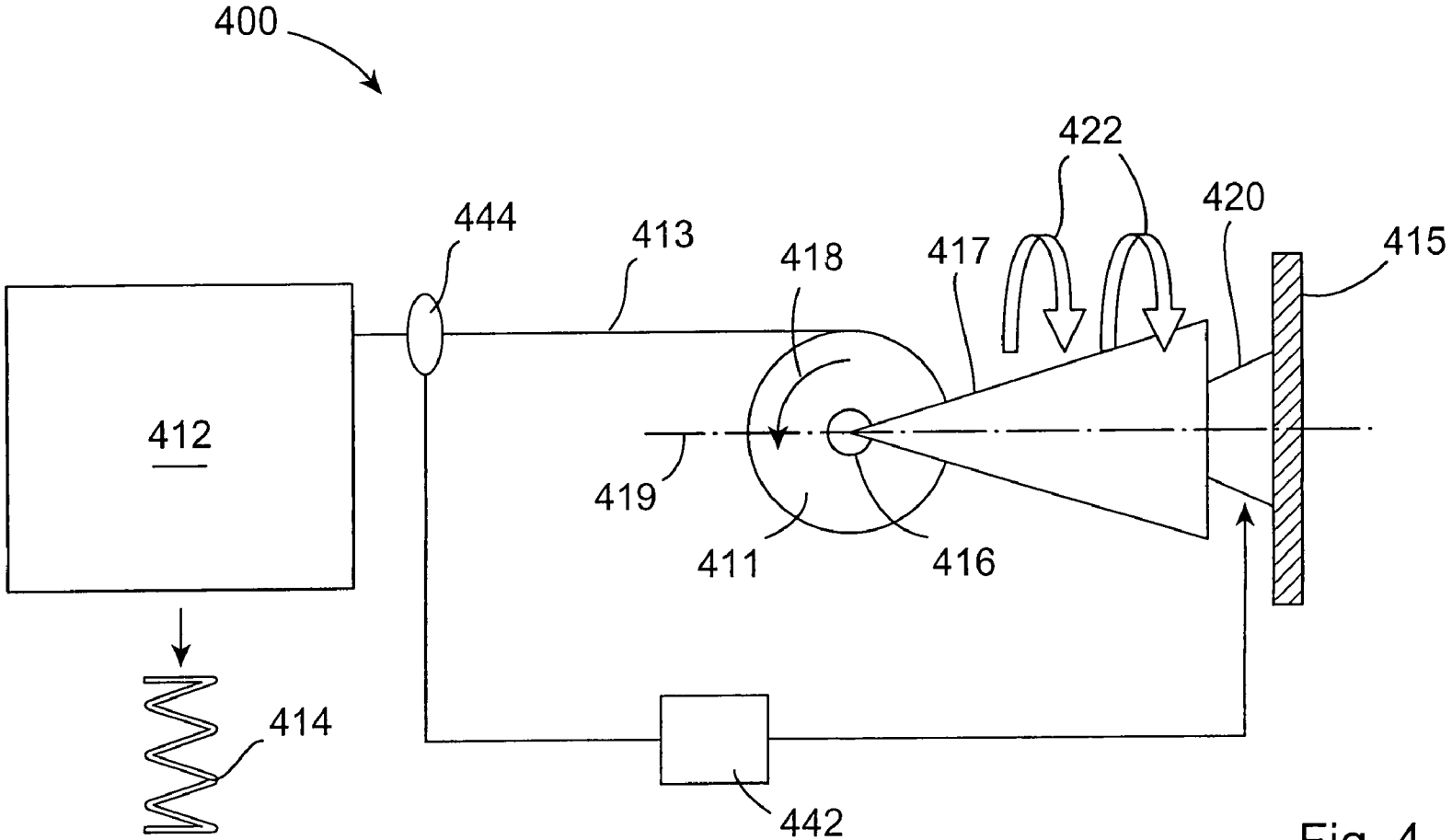
FIG. 4 depicts an alternative embodiment of a system, according to the invention, for forming a coil spring from multi-strand wire.

Turning to FIG. 4, a further embodiment is depicted wherein the mounting device 420 includes a mechanism for controlling the rate at which the spool 411 and mounting brace 417 rotate about the axis 419. To this end, the system 400 includes a torsional sensor 444 that fits within a feedback loop which measures the torsional force applied to the cable 413 and, responsive thereto, controls the rate at which the spool 411 rotates in a direction, say 418. In one embodiment, the mounting device 420 includes an electric motor and gear assembly that is responsive to the regulating element 442. The regulating element 442 couples to the sensor 444 which can, either optically, by mechanical contact or by other means monitor the torsional force applied to the cable 413. One example of a device for measuring torque applied to a turning cable is described in U.S. Pat. No. 6,564,653. As described therein a system is provided that allows for measuring torsional forces and for generating a signal representative of the measured force. In response to the measured force, the regulating mechanism 442 generates an input signal to the motor that controls the rate at which the motor turns the mounting brace 417 and spool 411. In this way, the torsional force may be more closely monitored and the system 420 can adjust to reduce the torsional force applied to the cable 413.

Figure 5:
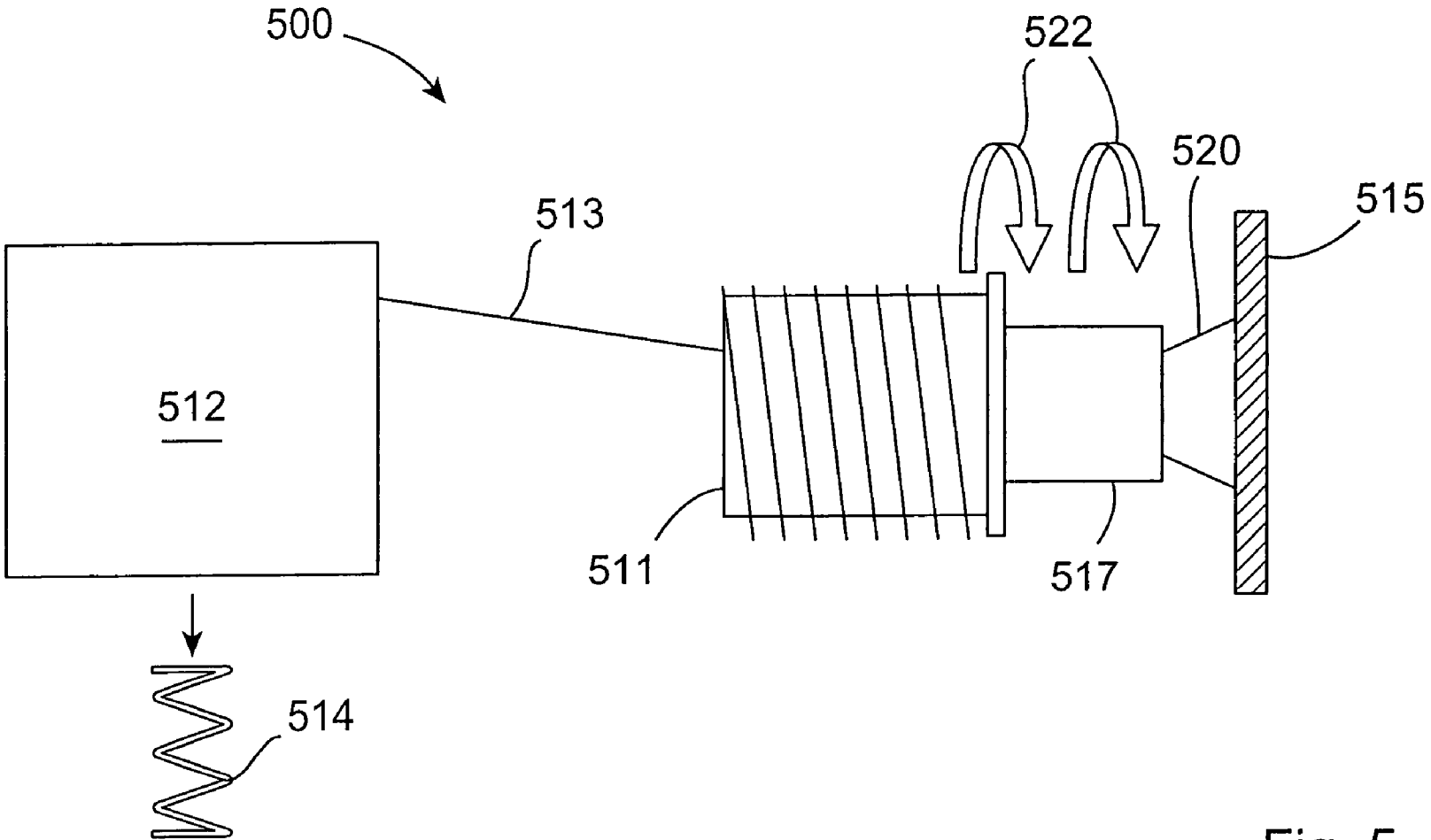
FIG. 5 depicts a further alternative embodiment of a system, according to the invention, for forming a coil spring from multi-strand wire.

The embodiments described above are merely representative of the systems and methods according to the invention. Many alternative embodiments may be achieved and the embodiment selected will depend, at least in part, on the application. For example, in some alternate embodiments, a feeder spool 511 may be employed that comprises a large spool of wire that lacks a central axis. In this embodiment, the spool 511 may be mounted to a brace 517 so that wire 513 may be taken sideways off the spool 511. FIG. 5 depicts one such an alternative embodiment.

Specifically, FIG. 5 illustrates an embodiment wherein the wire 513 is pulled off the spool 511 as it is fed into the coil winder 512. This is akin to pulling a garden hose off of a hose caddy. The coils of wire 513 unravel off the spool 511 as the wire 513 is fed into the winder 512. In this embodiment, torque can still build up on the wire 513. Consequently, the spool 511 is mounted by brace 517 to the coupling 520 that allows the spool to rotate and thereby prevent a build up of torque that is sufficient to fray or break the wire 513. The coupling 520 may be a ball bearing coupling capable of rotating in response to torque being applied to the wire 513. Optionally, the coupling 520 may include a torque-sensitive plate. The resistance of the plate may vary to compensate for the torsional torque imposed on it by the wire 513. In this alternate embodiment, the system may also employ a sensor 444 for sensing torsion, and the torsion information may be relayed to a regulator 442, such as those shown in FIG. 4. The regulator 442 then varies its resistance to maintain a predetermined torsional torque on the wire 413 or 513.

Figure 6:
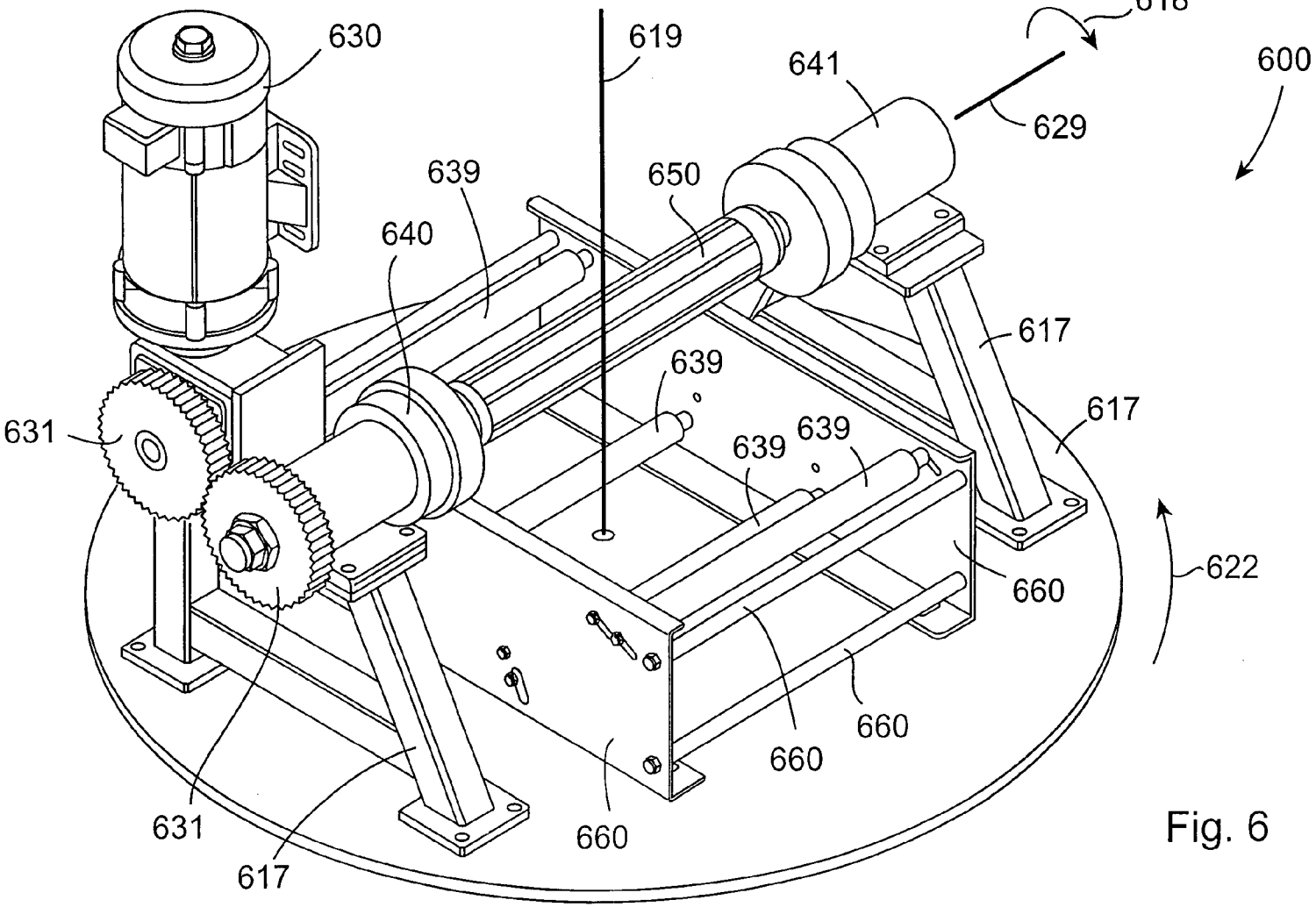
FIG. 6 depicts an embodiment of a system, according to the invention, for supplying multi-strand wire.

FIG. 6 depicts an embodiment wherein an optional first motor 630 drives the rotation of a spool (not shown) holding a supply of wire, installed on axle 650 to rotate about a spool axis 629, in a direction such as 618. Optionally, the first motor 630 may engage with the axle 650 via at least one gear wheel 631.

An embodiment may further include a first clutch 640 that engages to transmit torque from the first motor 630 to the spool axle 650. Optionally, the first clutch 640 may be a magnetic-particle clutch. Magnetic particle clutches, as is known in the art, are well suited for jerk-free start-stop motion control (typical in coil-winding processes wherein the wire holder must supply wire intermittently to the coil winder), for tension control along the longitudinal axis of the wire, and generally for a user-controlled engagement suitable for the application of interest.

For example, because the magnetic particles in a magnetic-particle clutch 640 respond essentially instantaneously to an electromagnetic field that may be applied to them, very quick response times can be achieved to control the motion of the spool (not shown in FIG. 6) that holds the supply of wire (not shown in FIG. 6), mounted on spool axle 650; this leads to longitudinal tension control along the wire. Engagement time of a magnetic-particle clutch can be adjusted by the user, as deemed appropriate for the application of interest; engagement may be gradual or very rapid. As is known in the art, the frequency and torque of the engagement-disengagement sequence of a magnetic-particle clutch are limited primarily by the capabilities of the electronic control circuitry that drives the clutch, and are substantially independent of slip speed; as is well known in the art, torque can be varied by the user by varying the input current to the magnetic clutch, the current determining the magnetic field that is applied to the magnetic particles in the clutch. Examples of magnetic-particle clutches suitable for use with the systems described herein are the Precision Tork magnetic clutches manufactured by Warner Electric of South Beloit, Ill.

In a further alternative embodiment, the systems and methods described herein may include a first brake 641 for adjusting the speed of rotation of the spool axle 650, and in turn adjusting the speed of rotation of the spool (not shown in FIG. 6). Optionally, the first brake 641 may be a magnetic-particle brake. A magnetic-particle brake operates according to principles not unlike those of a magnetic-particle clutch. Generally, a magnetic particle brake comprises four components: (a) a housing, (b) a shaft, disc, or axle, (c) a coil, and (d) magnetic powder (magnetic particles). The coil resides inside the housing, with the shaft, axle, or disc fitting inside. The axle is separated from the coil/housing by an air gap containing magnetic particles (powder). When an electric current is applied to the magnetic particle brake by an electronic control circuitry, an electromagnetic field is created that aligns the magnetic particles in a configuration more rigid than that prior to the application of the electric current. This magnetic flux (chain) is increased/decreased as the current is increased/decreased, respectively, thereby yielding an adjustable brake capability and torque transfer.

A magnetic-particle brake is useful in applications wherein the combination of the spool 211 and the supply of wire 213 that the spool holds, has large inertia. This is the case, for example, in mattress coil manufacturing, wherein a spool 211 holding a spring wire 213 is large and heavy. Due to the stop-and-pull motion that a spool 211 undergoes (a phenomenon having to do with methods for manufacturing mattress springs, known in the art), fast, yet smooth, braking of the spool 211 is desirable. For such applications, therefore, a magnetic-particle brake (such as 641, shown in FIG. 6) may be employed to control the speed (and/or stoppage) of the spool 211. Examples of magnetic-particle brakes are the Precision Tork magnetic brakes manufactured by Warner Electric of South Beloit, Ill.

In a further embodiment, the systems and methods described herein may include a second motor (not shown in FIG. 6) engaged with the mounting assembly 617, rotating the mounting assembly about a holding axis 619, in a direction such as 622. This is the motion of the wire holding and feed assembly that the systems and methods described herein are designed to employ to control a torsional torque that may accumulate on the multi-strand wire during the coil-winding process. The second motor may engage the mounting assembly via gear wheels similar to the wheels 631 shown in FIG. 6. Alternatively, the second motor may engage the mounting brace directly, for example by engaging a shaft whose axis is 619. In yet another embodiment, the first motor 630 may engage the mounting assembly 617, using, for example, a transmission device, for rotating the mounting assembly about the holding axis 619, thereby eliminating the need for a second motor to perform the same task. In other words, one motor may drive both rotational degrees of freedom.

In a further embodiment, the second motor may engage the mounting assembly 617 via a magnetic particle clutch not unlike 640, the second clutch intended to controllably transfer torque from the second motor to the mounting assembly 617 to rotate the mounting assembly 617 in, say, direction 622. In yet a further embodiment, the systems and methods described herein may include a second magnetic-particle brake (not shown in FIG. 6) to control the speed (and stoppage) of the mounting assembly in the rotation about axis 619.

In an embodiment, any subset of the first motor 630, the first magnetic-particle clutch 640, and the first magnetic-particle brake 641 may be controlled by a feedback control mechanism similar to that shown in FIG. 4 and described previously. The feedback control mechanism may include a sensor analogous to the torsional torque sensor 444; the sensor may be used to measure the rotational torque (about axis 629) on the spool holding the wire, or, alternatively, the tension along the wire 413, sending the measured torque information to a controller similar or identical to 442, which in turn adjusts the operation of the first motor 630, the first magnetic-particle clutch 640, the first magnetic-particle brake 641, or any combination of thereof.

Similarly, in an embodiment including any subset of the second motor, the second magnetic-particle clutch, and the second magnetic-particle brake, a feedback control mechanism may be used analogous to that described for FIG. 4, with a torsional torque sensor 444 measuring the torsional torque on the wire 413. The measured torsional torque information is then relayed to a controller analogous to 442, which then adjusts the operation of any subset of the second motor, the second magnetic-particle clutch, and the second magnetic-particle brake.

Examples of control devices analogous to 442 are the TCS-200-1 Manual/Analog Adjustable Torque controller, the MCS2000 Digital Web Tensioning controller, and MCS-203, MCS-204, and MCS-166 dancer control, all manufactured by Warner Electric.

Basic information about magnetic-particle clutches, magnetic-particle brakes, and their electronic controllers is contained in a brochure published by Warner Electric-DANA, located in South Beloit, Ill.; the brochure is titled "WARNER Magnetic Particle Clutches and Brakes."

Figure 7:
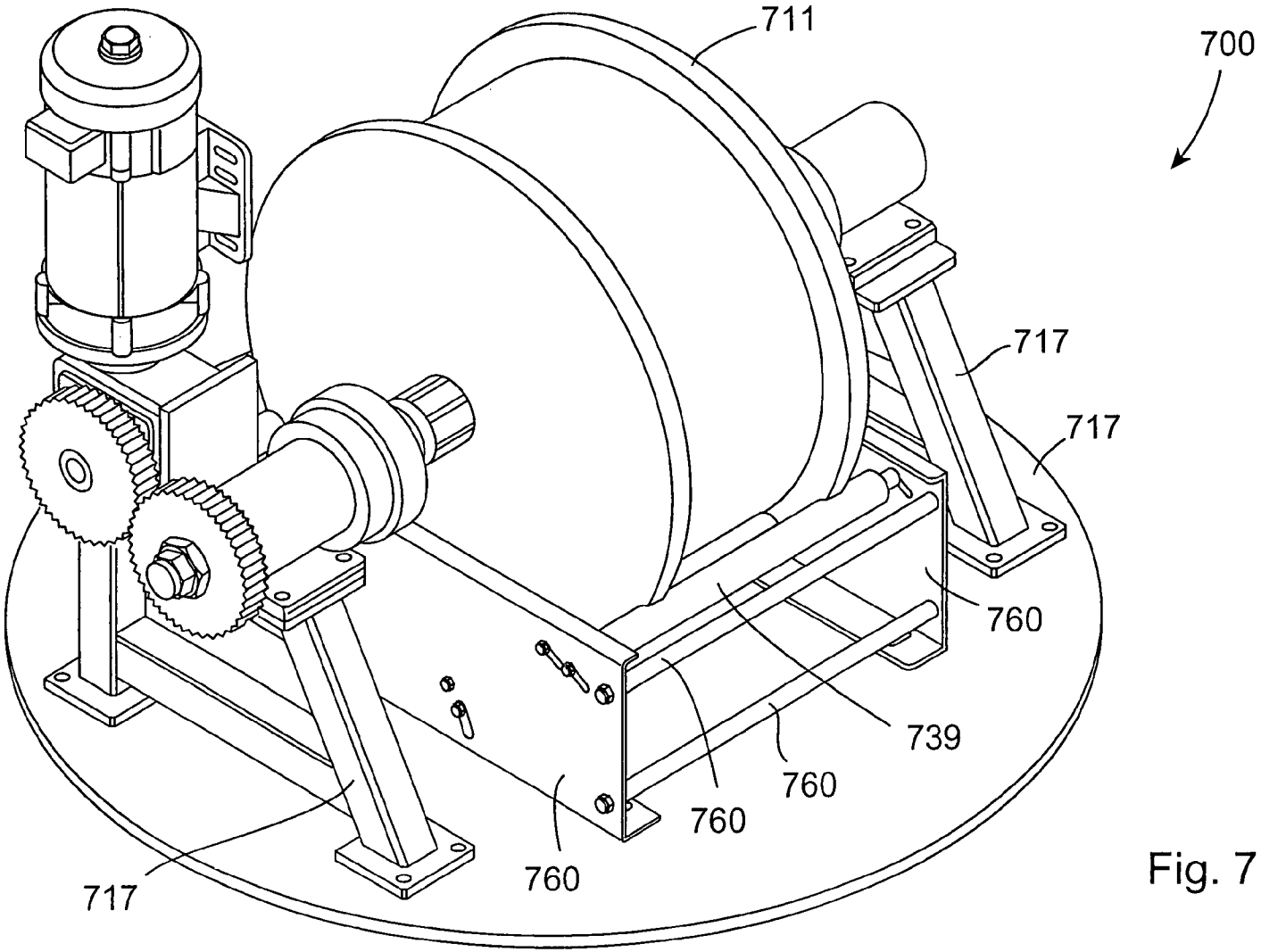
FIG. 7 depicts a further embodiment of a system, according to the invention, for supplying multi-strand wire.

Turning now to FIG. 7, an embodiment similar to FIG. 6 is depicted; the spool 711 is shown in FIG. 7. Frequently enough, during coil winding, especially in applications involving the manufacture of mattress coils, the wire is pulled off the spool 711 intermittently. Due to the generally large inertia of the spool, and the wire supply that it holds, the spool continues to rotate in the direction that it was actuated to rotate along, even after the wire is no longer solicited from the spool. This continued rotation of the spool—which can occur especially if a magnetic brake and/or clutch is not used to control the spool rotation—can cause a length of the wire to depart from the spool by more than an acceptable distance, thus causing problems, such as entanglement with nearby components. It is therefore desirable to ameliorate this condition. FIG. 7 shows a retainer 739 disposed on a retainer frame 760 that is attached to the mounting assembly 717. The retainer 739 is positioned sufficiently close to the wire supply held by the spool 711, so as to discourage the supply of wire (not shown) from departing from the spool 711 by more than a predetermined distance. This prevents the wire from unraveling from the spool 711 when the spool, due to its inertia, continues to rotate even after the wire is no longer pulled from it. The retainer may be a bar of any cross section, such as round, rectangular, elliptical, square, etc. The retainer need not be attached to the mounting assembly 717, but may be attached to a fixed reference fixture such as 115, though disposed in sufficient proximity to, or in contact with, the spool and/or the supply of wire to prevent a length of the wire from undesirably departing from the spool. FIG. 6, wherein the spool is not shown, depicts more clearly one embodiment having retainers 639 attached to a retainer frame 660; the retainers 639 discourage a length of wire from departing from the spool (not shown) at undesirable locations.

In a further embodiment, a retainer 639 may have an adaptively varying position, wherein the position depends on the supply of wire remaining on the spool. For example, a retainer may be spring-loaded to press against the supply of wire. As the wire is pulled off the spool, the retainer maintains a pressed position against the remaining supply of wire. As the wire supply diminishes, the retainer approaches the core axis of the spool. This embodiment may further include a sensor to measure the supply of wire remaining on the spool, using the adaptively-varying position of the retainer and at least one physical property of the wire (such as its thickness). In one embodiment, information about the remaining supply of the wire on the reel may be further used to influence the operation of any motor, magnetic-particle brake, or magnetic-particle clutch that the embodiment entails.

Those skilled in the art will know or be able to ascertain using no more than routine experimentation, many equivalents to the embodiments and practices described herein. For example, the illustrative embodiments rotate the spool of wire for the purpose of reducing torque. Optionally however, the feeder which pull wire into the winder may rotate, thereby preventing torque from being transferred to the spool. In either case, the systems and methods described herein include mechanisms for reducing torque building on a wire, as that wire is fed into a winder. Accordingly, it will be understood that the invention is not to be limited to the embodiments disclosed herein, but is to be understood from the following claims, which are to be interpreted as broadly as allowed under the law.

We claim:

1. An apparatus for manufacturing a coil spring from a wire, comprising a. a coil-spring winder that forms the wire into a coil spring having a plurality of turns; and b. a wire holder, including a reel being rotatable about a reel axis having a wire comprising a plurality of strands twisted together, that supplies the wire to the coil-spring winder along a feed direction, the wire holder supported, along a holding axis, by a coupling that allows the wire holder to rotate freely about the holding axis in response to a torque acting about a cross section of the wire, wherein the holding axis is oriented at a non-zero angle with respect to the reel axis, and rotation of the wire holder about the holding axis substantially alleviates the torque accumulated in the wire.

2. The apparatus of claim 1, wherein the holding axis is essentially aligned with the feed direction.

3. The apparatus of claim 1, wherein the rotation of the wire holder is synchronous with formation of the turns of the coil spring by the coil-spring winder.

4. The apparatus of claim 1, wherein the strands are overlaid.

5. The apparatus of claim 1, wherein the strands are braided.

6. The apparatus of claim 1, wherein the strands are helically twisted along a common axis.

7. The apparatus of claim 1, wherein at least one of the strands has a cross-section shape selected from a group consisting of round, ellipse, square, rectangle, rhombus, polygon, and polygon having curved edges.

8. The apparatus of claim 1, wherein at least one of the strands is essentially flat.

9. The apparatus of claim 1, wherein the reel axis is essentially orthogonal to the feed direction.

10. The apparatus of claim 1, further including a motor for rotating the reel about the reel axis, and for dispensing the wire along the feed direction from the wire holder.

11. The apparatus of claim 10, further comprising a tension sensor for measuring longitudinal tension along the wire.

12. The apparatus of claim 11, further comprising a motor controller responsive to the longitudinal tension measured by the tension sensor and being operatively engaged with the motor for regulating speed or direction of rotation of the motor.

13. The apparatus of claim 1, further including a motor for rotating the wire holder about the holding axis.

14. The apparatus of claim 13, further comprising a torque sensor for measuring torque acting about a cross section of the wire.

15. The apparatus of claim 14, further comprising a motor controller responsive to the torque measured by the torque sensor, the motor controller being operatively engaged with the motor for regulating speed or direction of rotation of the motor.

16. An apparatus for feeding, along a feed direction, a multi-strand wire to a coil-spring winder, comprising a wire holder including a reel holding a supply of the wire and being rotatable about a reel axis and supported, along a holding axis, by a coupling that allows the wire holder to rotate freely about the holding axis in response to a torque acting about a cross section of the wire, wherein the holding axis is oriented at a non-zero angle with respect to the reel axis, and the rotation about the holding axis substantially alleviates the torque accumulated in the wire.

17. The apparatus of claim 16, wherein the reel axis is essentially orthogonal to the feed direction.

18. The apparatus of claim 16, further comprising a motor for rotating the reel about the reel axis, for dispensing the wire along the feed direction from the wire holder.

19. The apparatus of claim 18, further comprising a tension sensor for measuring longitudinal tension along the wire.

20. The apparatus of claim 19, further comprising a motor controller responsive to the longitudinal tension measured by the tension sensor, and being operatively engaged with the motor for regulating the speed or direction of rotation of the motor.

21. The apparatus of claim 16, further comprising a motor for rotating the wire holder about the holding axis.

22. The apparatus of claim 21, further comprising a torque sensor for measuring torque acting about a cross section of the wire.

23. The apparatus of claim 22, further comprising a motor controller responsive to the torque measured by the torque sensor, and being operatively engaged with the motor for regulating speed or direction of the rotation of the motor.

24. An apparatus for manufacturing a coil spring from a wire, comprising a. a coil-spring winder that forms the wire into a coil spring having a plurality of turns, and that operates by pulling inwardly a supply of wire, and periodically stopping the supply of wire for forming a coil, and b. a wire holder, including a reel being rotatable along a reel axis, that supplies the wire to the coil-spring winder along a feed direction, the wire holder supported, along a holding axis, for free rotation about the holding axis in response to a torque acting about a cross section of the wire, and the wire holder being driven in synchronized operation with the coil-spring winder, for periodically starting and stopping the inward supply of wire, wherein the holding axis is oriented at a non-zero angle with respect to the reel axis, and rotation of the wire holder substantially alleviates the torque accumulated in the wire.

25. An apparatus for manufacturing a coil spring from a wire, comprising a. a coil-spring winder that forms the wire into a coil spring having a plurality of turns, and b. a wire holder, including a reel being rotatable about a reel axis, that supplies the wire to the coil-spring winder along a feed direction, the wire holder supported, along a holding axis, for free rotation about the holding axis in response to a torque acting about a cross section of the wire, c. a tension sensor for measuring longitudinal tension along the wire, and being responsive to the measured tension for regulating the speed or direction of rotation of the wire holder, wherein the holding axis is oriented at a non-zero angle with respect to the reel axis, and rotation of the wire holder substantially alleviates the torque accumulated in the wire.

26. An apparatus for manufacturing a coil spring from a wire, comprising a. a wire holder assembly, having a wire including a plurality of strands twisted together;

a wire holder, including a reel being rotatable along a reel axis, for holding the wire; and a low-friction coupling with a first axis rotationally linked to the wire holder, wherein a torque acting about a cross section of the wire is mechanically converted into a rotation of the wire holder about the first axis such that the rotation substantially alleviates the torque accumulated in the wire, the first axis being oriented at a non-zero angle with respect to the reel axis, and b. a coil-spring winder that forms the wire into a coil having a plurality of turns.

* * * * *